US008656538B2

(12) United States Patent
Holyfield

(10) Patent No.: US 8,656,538 B2
(45) Date of Patent: Feb. 25, 2014

(54) PILLOW BAND

(76) Inventor: Louise Holyfield, Dallas, TX (US)

( * ) Notice: Subject to any disclaimer, the term of this patent is extended or adjusted under 35 U.S.C. 154(b) by 236 days.

(21) Appl. No.: 12/924,739

(22) Filed: Oct. 4, 2010

(65) Prior Publication Data

US 2012/0079657 A1 Apr. 5, 2012

(51) Int. Cl.
*A47G 9/00* (2006.01)

(52) U.S. Cl.
USPC ..... 5/640; 5/636; 5/639; 5/657; 5/490

(58) Field of Classification Search
USPC ..... 5/630, 632, 636, 639, 640, 645, 420, 5/490, 637, 657; 297/219.1, 220, 221, 297/224
See application file for complete search history.

(56) References Cited

U.S. PATENT DOCUMENTS

| | | | | | |
|---|---|---|---|---|---|
| 243,228 | A | * | 6/1881 | Doremus | 5/645 |
| 1,580,210 | A | * | 4/1926 | McCulloch | 5/644 |
| 2,983,310 | A | * | 5/1961 | Warlick et al. | 297/399 |
| D282,407 | S | * | 2/1986 | Braun et al. | D2/866 |
| 5,168,590 | A | * | 12/1992 | O'Sullivan | 5/490 |
| 5,354,119 | A | * | 10/1994 | Nicholas | 297/188.07 |
| 5,454,185 | A | * | 10/1995 | Love | 43/57.1 |
| 5,953,749 | A | * | 9/1999 | Backs | 2/1 |
| 6,009,873 | A | * | 1/2000 | Neviaser | 128/845 |
| 6,149,234 | A | * | 11/2000 | Daniels | 297/229 |
| 6,526,612 | B1 | * | 3/2003 | Zarrella | 5/636 |
| 6,918,148 | B2 | * | 7/2005 | Auxila | 5/655 |

* cited by examiner

*Primary Examiner* — Nicholas Polito
(74) *Attorney, Agent, or Firm* — Gary C. Honeycutt

(57) ABSTRACT

A fabric band to be placed around a bed pillow, to enhance comfort and hygiene. The band provides a covered space on each side of the pillow, where the user may rest a hand for greater comfort. Also, a smaller pillow may be placed between the first pillow and the fabric band, to provide more specific support for the head and face. The band may include a moisture-resistant layer to protect the pillow and/or pillow case from saliva. This improves hygiene, and prolongs the life of the pillow.

5 Claims, 2 Drawing Sheets

PILLOW BAND

FIELD OF THE INVENTION

This invention relates to pillow accessories, and more particularly to products and methods of use with a pillow, to maximize the comfort, hygiene, and flexibility of a pillow while sleeping or resting.

BACKGROUND OF THE INVENTION

Very few individuals believe they have the perfect pillow. It reminds you of the story of the three bears: you search for a pillow that you feel is the most comfortable, based on the choices that you have when making your selection. Not too soft, not too hard, not too thick, nor too thin.

Unfortunately, due to drool (saliva) from an open mouth while sleeping, dust mites, and the natural breakdown of the pillow content, and the inability to launder most pillows, it would be prudent to buy a new pillow at least once a year, because a fresh pillow cover once a week is not enough to protect a pillow from germs and bacteria that will inevitably collect on and inside a pillow.

Almost everyone seeks greater comfort while sleeping. Proper support for the head, face and hands cannot be achieved with an ordinary pillow, regardless of its size, shape or degree of softness. The most common solution is to manipulate the pillow into a shape whereby you can find the most comfortable spot in which to rest your head, while tossing and turning during the night.

Another solution has been to attach a small second pillow to the standard pillow. For example, see U.S. Pat. No. 4,754,513 and U.S. Pat. No. 7,165,279 each of which shows a second pillow fixed in place, so that it cannot be moved, replaced, or manipulated during the night.

SUMMARY OF THE INVENTION

One aspect of the invention comprises a reversible fabric band to be placed around the circumference of a pillow, with or without a pillowcase, to provide a covered space on each side of the pillow between the pillow (or pillowcase) and the pillow band. When a smooth fabric band is selected, the new space becomes a convenient, comfortable place for your hand (s).

In one example, the reversible band consists of a single layer of fabric. In another example, the band consists of three layers of fabric. The two outer layers are smooth fabric, while the third, or inner layer consists of a moisture resistant fabric that creates a barrier to stop drool (saliva) from penetrating the pillow band, thus protecting the underlying pillow and/or pillowcase.

A single layer band may consist of any fabric; however, in most cases something soft and smooth is preferred, including silk or satin. A synthetic stretch fabric, or a stretch fabric blend is also preferred, because it can be fitted to remain in the stretched mode, thereby creating a smooth surface in which to lay the head and face, and minimizing the possibility of wrinkles on the face. For example, one such fabric or blend includes a polyurethane-polyurea copolymer, known as Spandex or Lycra.

The band may encircle either the width or the length of any pillow; however, it is usually more convenient to encircle the width. More than one band may be placed around the pillow at the same time based on function required; however, a single band is usually sufficient. Any band thickness is within the scope of the invention.

Another example of the invention comprises the combination of an ordinary pillow, with or without a pillowcase, surrounded by the new band or sleeve, and further including at least one second pillow placed in the space between the band and the pillow. Thus, the accessory band works with, or compliments an individual's regular bed pillow by protecting the pillow from drool (saliva) penetrating on and into the pillow. The option of selecting a small pillow of one's choice to place in the space created between the pillow band and one's regular pillow increases an individual's chances of finding the perfect support in which to place their head and face. There are several small pillows to select from: For example, there is a neck support pillow, a round cosmetic face pillow, and various contoured shapes and sizes designed for support and comfort.

When a smaller pillow is placed within the space created by the pillow band, it is supported by an Individual's own pillow, it becomes a more firm and specific support foundation for the head and face. The small pillow within the space created by the band does not encumber the remaining surface of the pillow, thus enabling a person to position the pillow to suit their individual sleeping style.

The reversible pillow band is open at both ends, which allows it to easily be pulled over a pillow. The flexibility for an individual to place their selected smaller pillow anywhere under the pillow band, or to remove it quickly, regardless of whether they use their right hand or left hand. The reversible pillow band may also be open on all four sides with the two sides sewn together at the corner edges of the band, thereby allowing the flexibility of inserting a regular pillow, or smaller pillow through any one of the four sides of the band.

The reversible pillow band can also encompass two pillows within the band space, thus allowing an individual to place their hands and arms between the two pillows in which to hug or snuggle the pillow while still enjoying the comfort of the second pillow underneath their hands and arms.

The accessory band can also be a half band, in which case it is sewn or attached to only one side of a pillow or pillow cover. The space created under the band would allow an individual to place their hand into the space under the pillow, thereby creating a hand held pillow. The small hand held pillow aids in the support of one's head and neck while traveling, or confined to a limited space for an extended period of time when the option of laying down is not available.

Another important feature of the pillow band is hygiene. Since many individuals do not bathe or cleanse their face/skin prior to falling asleep, the reversible drool (saliva) resistant pillow band would enable a person to quickly reverse the band, thereby having a clean surface in which to lay their head. A clean pillow surface that is free of bacteria is beneficial to everyone. Hygiene is an important part of one's overall grooming, and is especially important to teenagers, or anyone who has any type of skin disorder such as acne, eczema, rosacea, or anyone who is susceptible to dermatitis. Products that aid in minimizing germs and bacteria on a pillow or bed linens are basically non-existent.

The future marketing and use of a new organic anti-bacterial spray, formulated especially for use on fabrics that have close proximity to the face and skin, can be sprayed onto the band surface, aiding in the elimination of 99.9% of bacteria. Regular use would be recommended.

The opening at each end of the pillow band can be straight cut or the edges can each have elastic at the outer corners, thereby creating a contoured finish. Regardless of the finish of the pillow band, it will not affect the function of the band or the way the smaller pillow remains in place within the space of the band when in use. The same function applies if the pillow band is open on all four sides, or only on one side of a pillow, or pillow cover.

A compelling benefit is the smoother surface of the pillow band, compared with the surface of most pillows or pillow covers. Furthermore, the placement of a smaller pillow within the created pillow band space ensures that the surface over the smaller pillow is smooth and free of wrinkles. This eliminates lines or indentations that can be transferred to the skin from the loose fabric of a pillow or pillow cover.

The pillow band may be equal to or smaller in width compared with the length of the pillow it covers. Thus, a narrow band has open sides, while a wide band has open ends. The same would apply to the pillow band that is open on all four sides. The pillow band that attaches to only one side of a pillow may also be smaller in width compared with the length of the pillow and/or pillow cover to which it is attached.

DETAILED DESCRIPTION OF THE DRAWINGS

Figure 1:
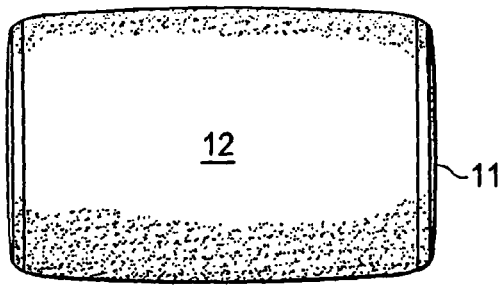
FIG. 1 is a perspective view showing the combination of a pillow, pillowcase, and pillow band encircling the width of the pillow.

As shown in FIG. 1, pillow 11 is surrounded by band 12. In this example the pillow cover is a standard cotton product, while band 11 is made of a spandex fabric fitted firmly around the pillowcase in a slightly stretched mode to avoid wrinkles.

Figure 2:
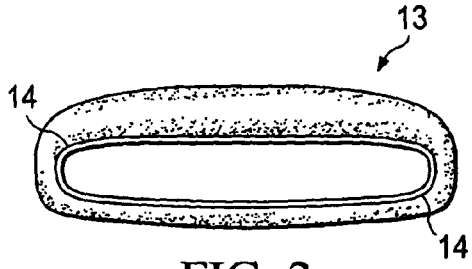
FIG. 2 is a perspective view of the pillow band, having elastic segments along the edges.

As shown in FIG. 2, band 13 is made of a cotton-polyester blend and is provided with elastic segments 14 to ensure a firm fit on a pillow.

Figure 3:
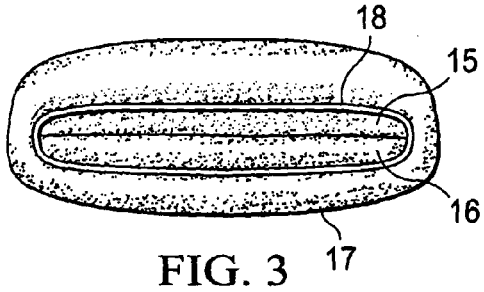
FIG. 3 shows a full band encircling two thin pillows comparable in thickness to one standard pillow, and a half band attached to the top of the full band, for holding a small pillow in that space.

As shown in FIG. 3, two pillows 15 and 16 are encircled by band 17, which includes a half band 18 for holding a small pillow.

Figure 4:
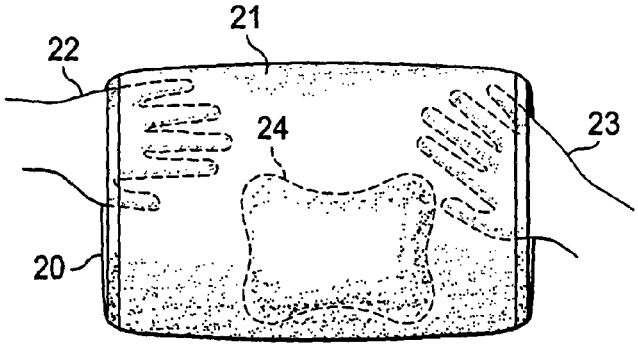
FIG. 4 shows a fabric band around the width of a single pillow, with a small pillow under the band, and a person's hand under each end, adding and/or removing a small pillow.

As shown in FIG. 4, pillow 20 is encircled by band 21. Hands 22 and 23 illustrate the ease and convenience of reaching under band 21 from one side of pillow 20; or to reach under band 21 from the other side of the pillow, to add, adjust or remove small pillow 24.

Figure 5:
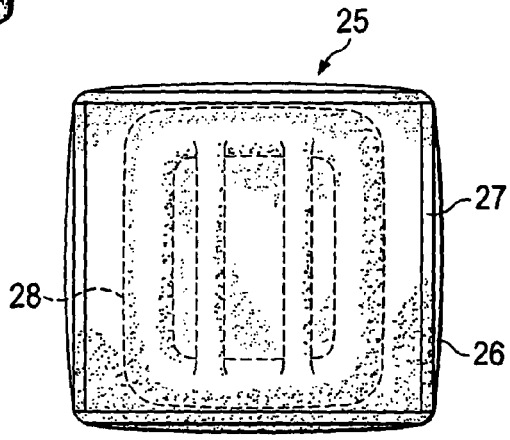
FIG. 5 shows a slightly oblong pillow encircled by a band that is open on all four sides, and a smaller square shaped pillow designed for back support, is outlined under the band.

As shown in FIG. 5, square pillow 25 and pillowcase 26 are encircled by band 27. Smaller pillow 28 is placed under the band to provide special support for the back.

Figure 6:
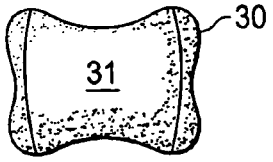
FIG. 6 shows a contoured pillow with a half band on one side for hand placement.

As shown in FIG. 6, small contoured pillow 30 is encircled by band 31 to provide a hand-held pillow to be used under the head while resting or sleeping during air travel, for example.

Figure 7:
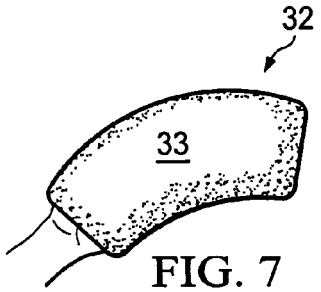
FIG. 7 shows a contoured pillow with a half band on one side with a hand inside for head and neck support.

As shown in FIG. 7, small hand-held tubular pillow 32 and band 33 are shaped to provide special support for the head during air travel, for example.

Figure 8:
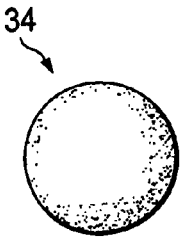
FIG. 8 shows a round wrinkle-free cosmetic pillow.

As shown in FIG. 8, small round wrinkle-free cosmetic pillow 34 is suitable for use in accordance with the invention.

Figure 9:
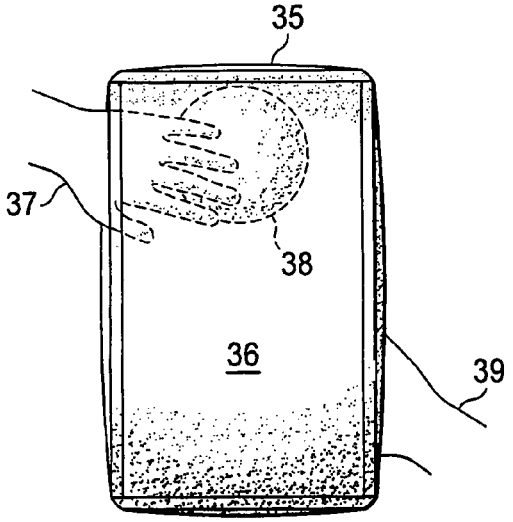
FIG. 9 shows a pillow band open on all four sides, encompassing the length of a pillow with a small round cosmetic pillow on top. The upper left hand reflects the ability to easily put in place, or remove, the small pillow through any one of the four openings in the band. When two thin pillows are placed within the band the hand (s) can easily be slipped between the two pillows, reflected by the lower right hand, enabling a person to hug or snuggle the pillow up close while having the support and comfort of the second (bottom) pillow beneath.

As shown in FIG. 9, the length of pillow 35 is encircled by band 36, while a first hand 37 is shown reaching under band 36 to adjust or remove small pillow 38, and a second hand 39 is positioned for comfort under band 36, on the other side of pillow 35. In this example band 36 is open on all four sides, enabling the user to access pillow 38 from all four directions. Even greater convenience and comfort can be achieved by replacing pillow 35 with two thin pillows, enabling the user to rest one hand between the two thin pillows, while enjoying the support of both pillows.

Figure 10:
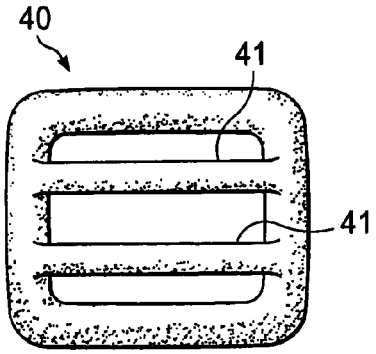
FIG. 10 shows a pillow designed for back support while sitting upright.

As shown in FIG. 10, pillow 40 includes ribs 41 designed for back support while sitting upright.

Figure 11:
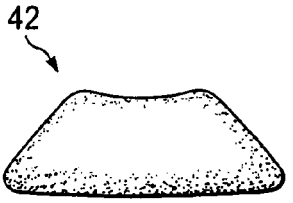
FIG. 11 shows a neck alignment pillow and head rest with a contoured scoop at the top designed to preserve one's hair style.

As shown in FIG. 11, a contoured neck alignment pillow 42 is designed to preserve one's hair style.

Figure 12:
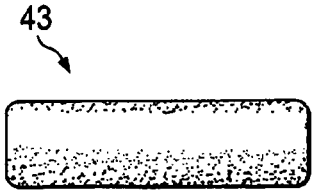
FIG. 12 shows a tubular neck support pillow.

As shown in FIG. 12, tubular pillow 43 is designed for neck support.

Figure 13:
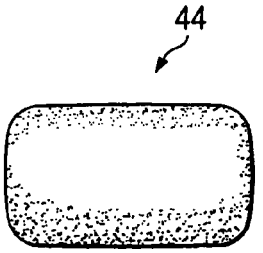
FIG. 13 shows an oblong pillow for upper head support while semi-inclined.

As shown in FIG. 13, small pillow 44 is shaped to provide special support for the face or the head, depending upon whether one is resting on their back or on their side.

Pillows 30 and 32 are useful in combination with a standard pillow, or they can be used separately, by attaching the half band of the invention to one side of the pillow. When used separately in such a manner, they are especially useful as hand-held pillows during air travel. When the back of your airline seat is "fully extended" it will still have a steep angle, which normally causes a small pillow to slip away from any desired location. However, by placing your hand between the band and the pillow, you will be readily able to hold the pillow in place.

The invention claimed is:

1. A method of improving comfort and hygiene while sleeping or resting with one's head on a bed pillow, comprising the steps of:

a) placing a pillow case on said pillow;

b) placing a fabric band completely around said pillow and pillow case, to protect the pillow and case, said band having a width sufficient to cover a user's hand, but less than the length of said pillow;

c) placing the user's head on said band; and d) placing the user's hand between said band and said case for added hand comfort.

2. A method as in claim 1, wherein said band is elastic, at least in part; and further including the step of selecting the length of said band to ensure that it remains stretched, thereby providing a smoother surface for added hand and face comfort.

3. A method as in claim 1, wherein said band is moisture resistant, to protect the pillow and case from saliva.

4. A method as in claim 1, further including the step of placing a second pillow on top of the first pillow, between the case and band, to enhance head support and comfort.

5. A method as in claim 1, wherein said band is both elastic and moisture resistant.

* * * * *